US005899777A

United States Patent [19]

Liang

[11] Patent Number: 5,899,777

[45] Date of Patent: May 4, 1999

[54] ELECTRIC WIRE CONNECTOR

[76] Inventor: Shih-Tsung Liang, No. 10, Lane 31, Ta-Fenq St., Lu-Chu Hsiang, Taoyuan County, Taiwan

[21] Appl. No.: 09/041,654

[22] Filed: Mar. 13, 1998

[51] Int. Cl.[6] ..... H01R 4/38

[52] U.S. Cl. ..... 439/805; 439/784

[58] Field of Search ..... 439/805, 784, 439/891, 801, 583, 584, 585

[56] References Cited

U.S. PATENT DOCUMENTS 3,444,505 5/1969 Becker ..... 439/805
5,362,253 11/1994 Lin et al. ..... 439/462
5,440,073 8/1995 Lin et al. ..... 174/74
5,573,423 11/1996 Lin et al. ..... 439/462
5,573,433 11/1996 Lin et al. ..... 439/805

*Primary Examiner*—Hien D. Vu
*Assistant Examiner*—Ross N. Gushi
*Attorney, Agent, or Firm*—Rosenberg, Klein & Bilker

[57] ABSTRACT

An electric wire connector includes a hollow tubular fitting element screwably fitted into a screw hole on a conductive connector, a hollow tubular plug element rotatably coupled to one end of the fitting element to secure inwardly extended wire strands of an electric wire being inserted through the fitting element and the plug element in positive contact between the plug element and the periphery of the screw hole of the conductive connector.

2 Claims, 2 Drawing Sheets

ELECTRIC WIRE CONNECTOR

BACKGROUND OF THE INVENTION

The present invention relates to an electric wire connector, and more particularly to such an electric wire connector which improves the drawback of the electric wire connector constructed according to U.S. Pat. No. 5,573,433.

The electric wire according to U.S. Pat. No. 5,573,433, which was issued on Nov. 12, 1996 to the present inventor, comprises a hollow tubular fitting element and a hollow tubular plug element inserted into a front end of the fitting element. The plug element has an annular curved rim which may press against a front edge of the fitting element when the plug element is inserted into the fitting element. The fitting element is further provided with external threads at a middle section thereof for enabling the fitting element to be screwably inserted into a screw hole of a conductive element. An electric wire has the plastic skin at a front end portion thereof stripped to expose the wire strands. The electric wire is inserted via a rear end of the fitting element with the stripped skin pressing against a rear end of the plug element so that the wire strands pass through the fitting element and the plug element to expose on the outside. The wire strands are bent inwardly to lie against the curved rim so that it may be held firmly between the curved rim of the plug element and the fitting element after the fitting element is fitted together with the plug element into the conductive hole, thereby causing the electric wire from possible damage. Because the plug element and the fitting element are separate members, the procedure of installing the wire strands of the electric wire is complicated.

SUMMARY OF THE INVENTION

The present invention has been accomplished to provide an electric wire connector which eliminates the aforesaid problem. According to the present invention, the electric wire connector comprises a hollow tubular fitting element and a hollow plug element coupled together and fastened to a screw hole on a conductive connector to secure an electric wire to the conductive element, wherein the hollow tubular fitting element comprises an inside annular flange within the longitudinal center through hole thereof at one end, the hollow tubular plug element comprises a coupling portion of reduced outer diameter at one end around the longitudinal center through hole thereof, the coupling portion being inserted into the longitudinal center through hole of the hollow tubular fitting element and punched outwards and hooked on the inside annular flange inside the hollow tubular fitting element for permitting the hollow tubular plug element and the hollow tubular fitting element to be relatively rotatably coupled together.

DETAILED DESCRIPTION OF THE PREFERRED EMBODIMENT

Figure 1:
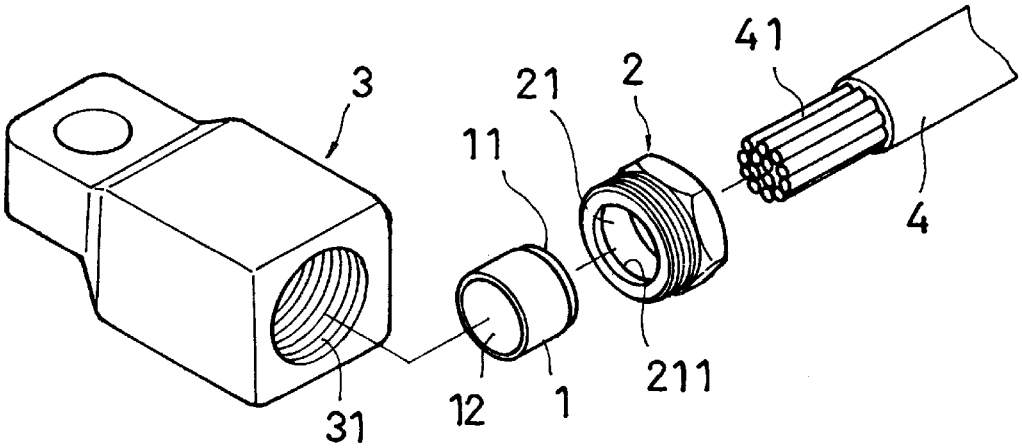
FIG. 1 is an exploded view of the present invention.
Figure 2:
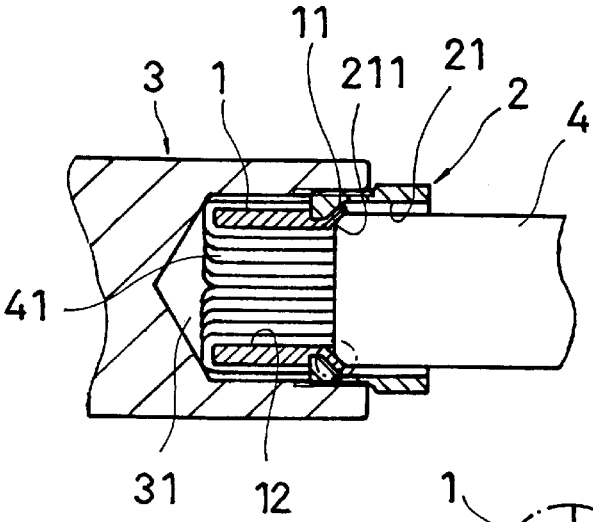
FIG. 2 is an assembly view in section of FIG. 1.
Figure 2A:
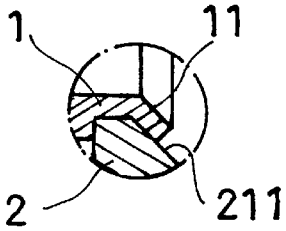
FIG. 2A is an enlarged view of a part of FIG. 2.

Referring to FIGS. 1, 2 and 2A, an electric connector in accordance with the present invention is generally comprised of a hollow tubular fitting element 2, and a hollow tubular plug element 1. The hollow tubular fitting element 2 comprises a longitudinal center through hole 21, and an inside annular flange 211 within the center through hole 21 at one end thereof, namely, the front end. The tubular plug element 1 comprises a longitudinal center through hole 12, and a coupling portion 11 of reduced outer diameter at a rear end thereof around the longitudinal center through hole 12. The coupling portion 11 of the tubular plug element 1 is fitted into the front end of the tubular fitting element 2, and then the coupling portion 11 is expanded outwards by punching and hooked on the inside annular flange 211 inside the tubular fitting element 2 (see FIG. 2A). Therefore, the tubular plug element 1 and the tubular fitting element 2 are coupled together, and can be rotated relative to each other. The fitting element 2 has external threads provided at a middle section thereof, whereby the fitting element 2 may be screwably fitted into a screw hole 31 of a conductive connector 3. An electric wire 4 has the plastic skin at a front portion thereof stripped to expose a suitable length of wire strands 41. The electric wire 4 is then inserted with its front portion into the fitting element 2 via the rear end of the fitting element 2 with the stripped plastic skin just urging against the rear end of the plug element 1 and the wire strands 41 passing through the fitting element 2 and the plug element 1 to expose on the outside of the plug element 1. The exposed wire strands 41 are then bent inwardly to lie against the outside wall of the plug element 1. At this time, when the fitting element 2 is screwably fitted into the conductive connector 3, since the plug element 1 will not synchronously turn with the fitting element 2, the exposed wire strands 41 may be held tightly between the outside wall of the plug element 1 and the screw hole 31 of the conductive connector 3, preventing the exposed wire strands 41 from possible damage due to friction which may in turn undermine the conductivity of the electric wire 4.

Figure 3:
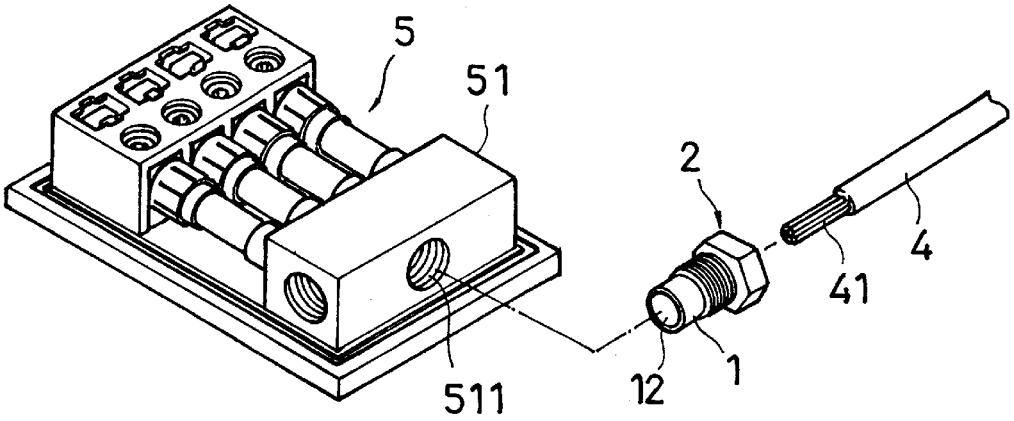
FIG. 3 shows the electric connector used with a fuse holder according to the present invention.

Referring to FIG. 3, the fitting element 2 may be screwably fitted into a screw hole 511 of a conductive block 51 at one side of a fuse holder 5 to secure the exposed wire strands 41 tightly between the outside wall of the plug element 1 and the screw hole 511 of the conductive block 51, preventing the exposed wire strands 41 from possible damage.

Figure 4:
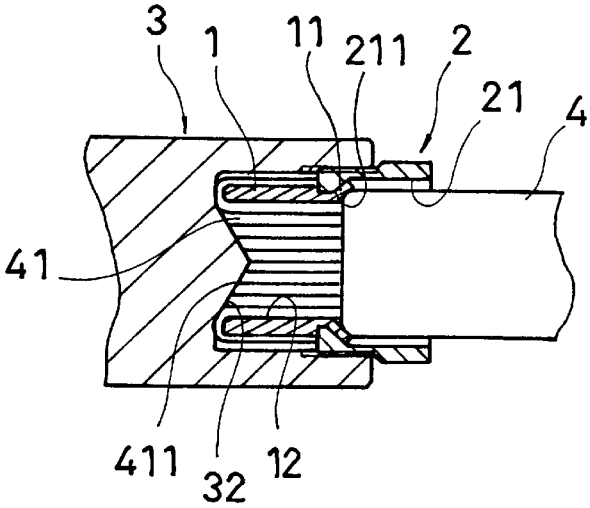
FIG. 4 is a sectional view of an alternate form of the present invention.

FIG. 4 shows an alternate form of the present invention, in which the conductive connector 3 has a conical projection 32 at the center of the bottom end of the screw hole 31. The conical projection 32 engages into a recessed portion 411 at the center of the inwardly extended exposed wire strands 41 when the fitting element 2 is screwably fitted into the screw hole 31. This arrangement greatly increases the contact area between the wire strands 41 and the conductive connector 3.

It is to be understood that the drawings are designed for purposes of illustration only, and are not intended as a definition of the limits and scope of the invention disclosed.

What is claimed is:

1. The electric wire connector comprising a conductive connector having a screw hole; a hollow tubular fitting element having external threads provided at a middle section thereof for enabling said fitting element to be screwably fitted into the screw hole on said conductive connector; and a hollow tubular plug element coupled to one end of said hollow tubular fitting element and inserted with said hollow tubular fitting element into the screw hole on said conductive connector to secure wire strands of an electric wire being inserted through said hollow tubular fitting element and said hollow tubular plug element between an outside wall of said hollow tubular plug element and the periphery of the screw hole of said conductive connector; wherein said hollow tubular fitting element comprises an inside annular flange within a longitudinal center through hole thereof; said hollow tubular plug element comprises a coupling portion of reduced outer diameter at one end around the longitudinal center through hole thereof, said coupling portion being inserted into the longitudinal center through hole of said hollow tubular fitting element and punched outwardly and hooked on the inside annular flange inside said hollow tubular fitting element for permitting said hollow tubular plug element and said hollow tubular fitting element to be relatively rotatably coupled together.

2. The electric wire connector of claim 1, wherein said conductive connector comprises a conical projection inside said screw hole at the center of the screw hole, said conical projection engaging into a recessed portion at the center of the inwardly extended exposed wire strands of said electric wire when said hollow tubular fitting element is screwably fitted into said screw hole of said conductive connector.

* * * * *